US006000998A

United States Patent [19]

Anderson, III

[11] Patent Number: 6,000,998

[45] Date of Patent: Dec. 14, 1999

[54] SYSTEM FOR CALIBRATING WAFER EDGE-GRINDER

[75] Inventor: David T. Anderson, III, Vancouver, Wash.

[73] Assignee: SEH America, Inc., Vancouver, Wash.

[21] Appl. No.: 09/087,836

[22] Filed: May 29, 1998

[51] Int. Cl.[6] ..... B24B 49/00

[52] U.S. Cl. ..... 451/9; 451/43; 451/339

[58] Field of Search ..... 451/5, 8, 9, 43, 451/44, 331, 339; 279/4.02, 126, 132, 133

[56] References Cited

U.S. PATENT DOCUMENTS

| | | | |
|---|---|---|---|
| 4,864,779 | 9/1989 | Ozaki . | |
| 5,185,965 | 2/1993 | Ozaki . | |
| 5,333,413 | 8/1994 | Hashimoto | 451/8 |
| 5,609,514 | 3/1997 | Yasunaga et al. | 451/65 |
| 5,658,189 | 8/1997 | Kagamida | 451/66 |
| 5,741,172 | 4/1998 | Trionfetti et al. | 451/21 |
| 5,807,166 | 9/1998 | Bando | 451/43 |
| 5,839,943 | 11/1998 | Stadfeld | 451/8 |
| 5,846,121 | 12/1998 | Hayashi et al. | 451/8 |
| 5,868,857 | 2/1999 | Moinpour et al. | 134/6 |
| 5,885,131 | 3/1999 | Azarian et al. | 451/5 |
| 5,890,949 | 4/1999 | Shibata | 451/5 |
| 5,904,608 | 5/1999 | Watanabe | 451/5 |

*Primary Examiner*—Timothy V. Eley
*Attorney, Agent, or Firm*—Kolisch Hartwell Dickinson McCormack & Heuser

[57] ABSTRACT

A wafer edge grinding machine including a chuck rotatable about a first axis, a chuck basin having bottom and side walls surrounding the chuck and a fine aligner disposed over an open top of the basin and configured to deliver wafers to the chuck. The machine further includes a probe having a sensor contact surface and a shifting mechanism adapted to selectively withdraw the sensor contact surface to a storage position and extend the contact surface to a measurement position. The probe also includes a mounting structure adapted to secure the probe to one of the walls in the basin with the probe being mounted in the basis to position the contact surface adjacent the perimeter of a wafer disposed on the chuck. The shifting mechanism includes a remotely operable control adapted to allow a user to operate the shifting mechanism from a location remote from the basin.

8 Claims, 2 Drawing Sheets

SYSTEM FOR CALIBRATING WAFER EDGE-GRINDER

FIELD OF THE INVENTION

This invention relates to calibrating the positioning of silicon wafers on a rotatable chuck in preparation for edge grinding.

BACKGROUND

In the course of producing semiconductor wafers, it is necessary to grind a predetermined profile or bevel on the perimeter of the wafer. Typically, this step is carried out on a machine known as an edge grinder, which has a rotatable chuck onto which the wafer is placed. The wafer is held in place by a vacuum created between the wafer and the surface of the chuck. As the chuck is rotated, the edge of the wafer is carried past a spinning grinding head to create the desired profile.

Because the perimeter of the wafer is rotated past the grinding head by the chuck, it is critical that the wafer be positioned perfectly centered over the rotation axis of the chuck. If the wafer is positioned off-center, a "grind out" may occur, where the grinding head does not contact the entire perimeter of the wafer because of the eccentric position of the wafer. Any grind out on a wafer makes the wafer unusable and thus reduces overall production.

About once a month, or when the wafer size is changed or a grind out occurs, an operator must carry out a master centering procedure whereby the positioning of wafers on the chuck is readjusted. In a typical machine, wafers are placed on the chuck by a fine-aligner which carries the wafers from a staging area at the side of the chuck to the chuck. The fine aligner moves the wafer laterally from a staging area to a predetermined location which should be laterally centered over the chuck. The chuck moves the wafer transversely in the front/back direction to carry the wafer from where it is dropped by the fine aligner into the grinding station. For the wafer to be properly centered on the chuck, the lateral position of the fine aligner and the front/back location of the chuck both must be correct when the wafer is released by the fine aligner.

The master centering procedure requires the operator to measure the eccentricity of the placement of the wafer on the chuck. This is accomplished by monitoring the position of the perimeter of a precisely machined test plate as it is rotated on the chuck. The plate has the same dimensions as the wafer, but is precisely machined for use as a reference. If the plate is dropped off-center, the perimeter of the plate will move in and out as the chuck is rotated. By measuring the position of the edge of the plate at 90-degree increments of rotation, an operator can calculate how much off center the wafer is and in what direction. Once the front/back and lateral errors are known, the operator can adjust the front/back position of the chuck and the lateral drop point of the fine adjuster to restore proper centering.

Unfortunately, in the past, the master centering procedure has been rather time-consuming to complete because of the difficulty of gaining access to the perimeter of the wafer to make measurements. In particular, the fine aligner obstructs access from above and the chuck is enclosed by a basin surrounding the sides and bottom. As a result, it has been necessary to reopen the fine aligner and reposition the measuring instrument for each measurement. The measuring instrument is typically a dial indicator mounted to an articulated arm connected to a magnetic base secured to a brace disposed above the chuck. Multiple measurements are required because the corrections entered may not correlate exactly with the physical repositioning of the chuck and fine aligner due to play in the mechanisms involved and inaccuracies of the measurement process resulting from the length of the arm on the measuring instrument. Normally, several measurement/correction cycles must be carried out to obtain the correct centering. Since each cycle may take several minutes, the overall process often requires an hour or more of operator time to complete, including setup time. During this time, the machine is, of course, out of production.

DETAILED DESCRIPTION

Figure 1:
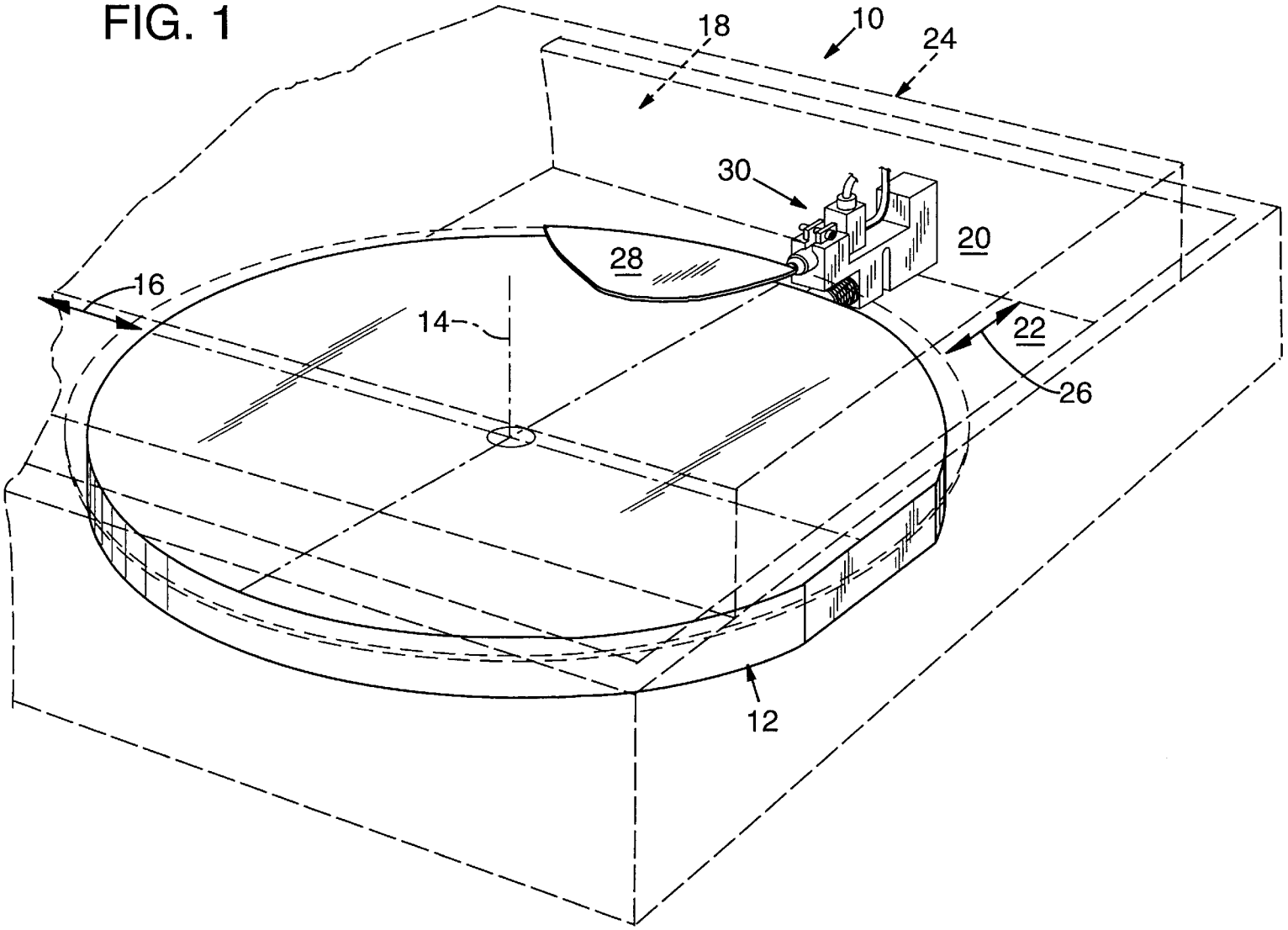
FIG. 1 is a perspective view of a portion of a wafer edge-grinding machine configured according to the present invention.

A portion of a wafer edge-grinding machine, such as an Emtec/Daitron DE(N)P 250 edge grinder, configured according to the present invention, is shown generally at 10 in FIG. 1. The edge grinder includes a chuck 12 which is rotatable about a central axis 14 and shiftable along a transverse axis 16 from a loading position, as shown, to a rearwardly located grinding position (not shown). The chuck is disposed in a basin 18 formed in the machine and the basin has side and bottom walls 20, 22, respectively.

The upper portion of basin 18 is substantially covered by a fine aligner 24 which is configured to move side-to-side along a lateral axis 26 to deliver wafers 28 from a staging area (not shown) to the chuck. For the fine aligner to deliver the wafer to the chuck at the proper location, the fine aligner must stop at the proper location along lateral axis 26 and the chuck must be positioned at the proper spot along axis 16. Any offset of either the chuck or the fine aligner from the intersection of these two axes will result in the wafer being deposited off-center on the chuck.

Over time the mechanisms which move the chuck and fine aligner through their cycles during use can develop drift or wear which results in offset positioning of the wafer on the chuck. Correct centering is reestablished through a master centering procedure in which a reference test plate/wafer is deposited on the chuck and the centering is measured. In particular, a probe 30 is provided to measure the radial position of the perimeter of the wafer as the chuck rotates. It should be noted that, in this application, the term wafer is used to refer to either a semiconductor wafer or a test plate designed to substitute for a wafer in the master centering procedure.

Figure 2:
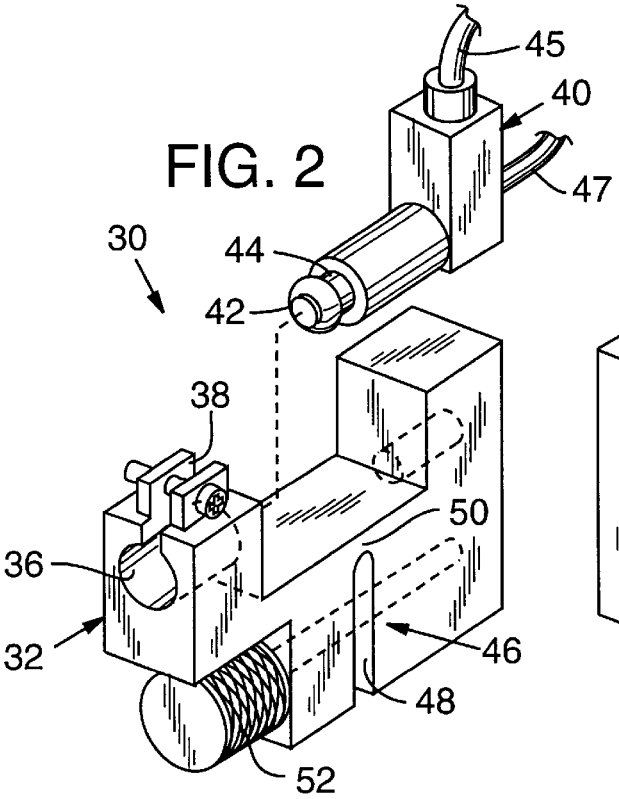
FIG. 2 is an exploded perspective view of a probe according to the present invention.
Figure 3:
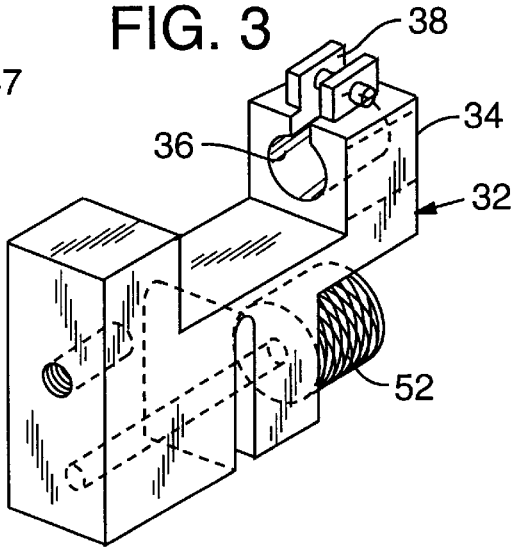
FIG. 3 is a perspective view of a mounting structure according to the present invention.
Figure 4:
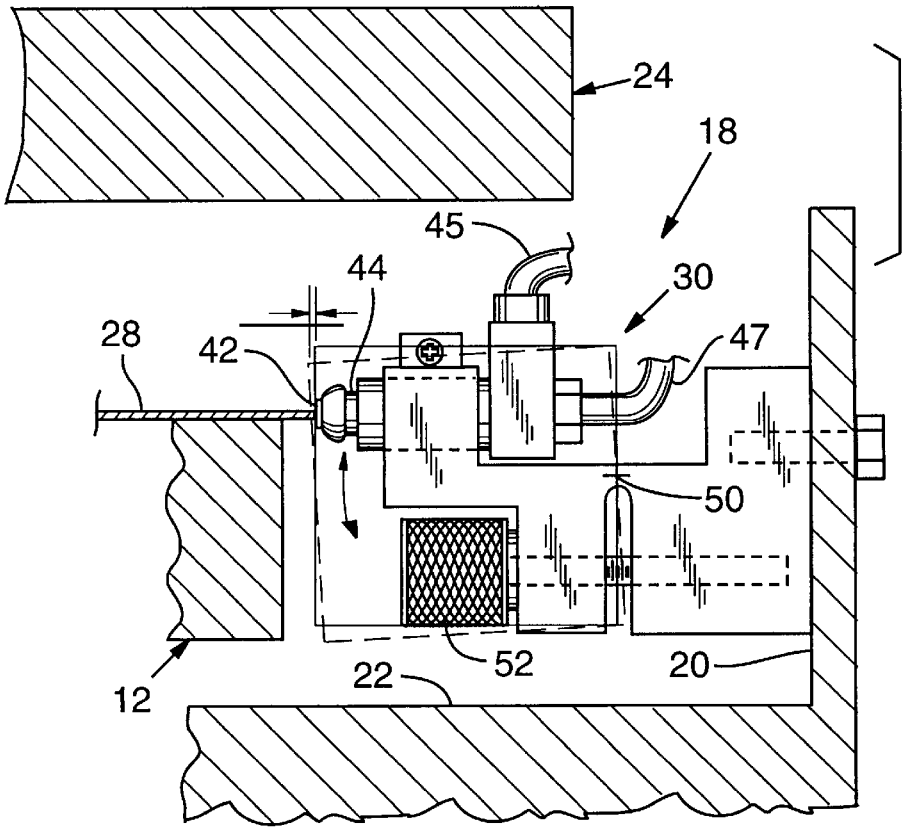
FIG. 4 is a partial cross-sectional view of the probe of FIG. 2 mounted in the machine of FIG. 1.

As shown in FIG. 2, probe 30 includes a mounting structure 32 which is preferably formed of UHMW and bolted to a side wall of the basin. The mounting structure includes a sensor mounting section 34 with a sensor receiving bore 36. A slot 38 allows the sensor receiving bore to expand and contract slightly to clamp or release a position sensor 40. Sensor 40 is preferably a Tesa GT44, and includes a sensor contact surface 42 disposed at the end of a plunger 44. Sensor 40 is equipped with an internal vacuum-controlled shifting mechanism to shift the plunger and sensor contact surface between a measurement position as shown in FIG. 4 and a storage position, where plunger 44 and sensor contact surface 42 are moved away from the perimeter of the wafer, (to the right in .4). An electrical cable 45 sends signals to a remote display and a vacuum line 47 is provided to operate the shifting mechanism. By controlling the application of vacuum to the vacuum line, the operator is able to selectively control the operation of the shifting mechanism from a remote location.

The mounting structure is configured to position the sensor contact surface adjacent the perimeter of the wafer when the sensor contact surface is in the measurement position. When the wafer is being placed on or removed from the chuck the sensor contact surface is withdrawn to the storage position so that it does not interfere with manipulation of the wafer.

A sensor fine-adjust mechanism 46 is provided on mounting structure 32 to allow the position of the sensor to be adjusted for zeroing. Fine-adjust mechanism includes a vertical channel 48 formed most of the way through the middle of the mounting structure, leaving a hinge region 50. An adjustment screw 52 is provided to span the channel and can be tightened or loosened to close or open the channel and thereby shift the sensor body toward or away from the wafer slightly to zero the sensor as indicated by comparison of the dashed and solid squares in FIG. 4.

When a master centering procedure is required, an operator installs the mounting structure and sensor in the basin in a location that will not interfere with the operation of the fine aligner. For subsequent procedures, either the mounting structure and/or sensor may be left in the basin or removed between calibrations. Once the sensor is in place, the operator uses the fine aligner to place a wafer on the chuck. The shifting mechanism is then triggered to shift the sensor contact surface into contact with the edge of the wafer. The operator can utilize the fine-adjust mechanism to bring the probe within zeroing range, if necessary. See FIG. 4.

With the sensor measuring the position of the edge of the wafer, the operator rotates the chuck while monitoring the read-out from the probe. Typically, the operator will take measurements at 90-degree intervals around the perimeter of the wafer. With the measurements obtained, the operator computes the offset of the wafer on the chuck and enters appropriate corrections to the fine-aligner and chuck to bring the wafer back into center. For instance, the operator may instruct the machine to shift the chuck three-thousands back and the fine-aligner two-thousandths to the left in the loading position.

After having retracted the sensor contact surface, the wafer is picked up by the fine-aligner and repositioned on the chuck, and the measurement process is repeated to verify that the corrections resulted in proper centering. It is not uncommon to have to go through several measurement cycles to obtain correct alignment due to various impressions in the positioning mechanisms involved. It can be seen, however, that the operator is able to complete the repeated measurement cycles without removing or replacing the probe and without displacing the fine-aligner to gain access to the perimeter of the wafer as required by prior art systems. As a result, the operator is able to carry out the master centering procedure more precisely and more rapidly than was previously the case.

Industrial Applicability

It may be seen, then, that the invented method and apparatus are applicable in the manufacture of semiconductor-based products, and particularly provide the advantages of increased accuracy and speed in carrying out master centering procedures on edge grinding machines. An additional advantage is that existing machines may be easily retrofitted with a probe according to the present invention.

While the invention has been disclosed in its preferred form, it is to be understood that the specific embodiment thereof as disclosed and illustrated herein is not to be considered in a limiting sense as numerous variations are possible and that no single feature, function or property of the preferred embodiment is essential. The invention is to be defined only by the scope of the issued claims.

I claim:

1. A method of master centering a semiconductor wafer edge-grinding machine, where the machine includes a loading basin having bottom and side walls, a chuck disposed in the basin and rotatable about a central axis and a fine aligner adapted to deposit a wafer on the chuck at a predetermined position for grinding, the method comprising:

providing a position reporting probe with a mounting structure adapted to be secured to a predetermined position on one of the walls of the basin, the probe being equipped with a sensor contact surface and a shifting mechanism adapted to selectively withdraw the sensor contact surface to a storage position and extend the contact surface to a measurement position;

securing the probe to one of the walls of the basin with the sensor contact surface positioned to contact the perimeter of a wafer disposed on the chuck, the probe being secured within the basin in a position that does not interfere with operation of the fine aligner;

with the probe secured in the basin and the sensor contact surface disposed in the storage position, operating the fine aligner to deposit a wafer on the chuck;

with the fine aligner in a closed position:

shifting the sensor contact surface into the measurement position against a point on the perimeter of the wafer with the shifting mechanism;

measuring the radial position of the point on the perimeter of the wafer relative to the central axis;

rotating the chuck to bring a new point on the perimeter of the wafer into contact with the sensor contact surface;

repeating the step of measuring the point on the perimeter of the wafer for the new point; and recalibrating the position where the fine aligner deposits the wafer onto the chuck according to the results of the measuring steps.

2. The method of claim 1, further comprising:

withdrawing the sensor contact surface to the storage position with the shifting mechanism;

using the fine aligner to pickup and redeposit the wafer on the chuck at the recalibrated position; and repeating the steps of shifting, measuring, rotating, repeating and recalibrating, where the steps of withdrawing and using are carried out with the fine aligner closed.

3. The method of claim 1, wherein the shifting mechanism is vacuum actuated and operable from a location remote from the probe.

4. The method claim 1, wherein the probe is connected to a remote display device.

5. The method of claim 1, further comprising providing the probe mounting structure with a mechanical zero-adjust.

6. The method of claim 1, wherein the wafer is a machined test plate.

7. A wafer edge grinding machine comprising:

a chuck rotatable about a central axis;

a chuck basin having bottom and side walls surrounding the chuck;

a fine aligner disposed over an open top of the basin and configured to deliver wafers to the chuck; and a probe equipped with a sensor contact surface and a shifting mechanism adapted to selectively withdraw the sensor contact surface to a storage position and extend the sensor contact surface to a measurement position, the probe further including a mounting structure adapted to be secured to one of the walls in the basin, the probe being mounted in the basin to position the sensor contact surface adjacent the perimeter of a wafer disposed on the chuck, where the shifting mechanism is remotely operable to allow a user to operate the shifting mechanism from a location remote from the basin.

8. The wafer edge grinding machine of claim 7, wherein the shifting mechanism is vacuum controlled.

* * * * *